US012630983B2

(12) United States Patent
Kumari et al.

(10) Patent No.: US 12,630,983 B2
(45) Date of Patent: May 19, 2026

(54) INTERCHANGE SYSTEM FOR A ROADWAY

(71) Applicants: Deepti Kumari, New Delhi (IN); Fani Bhushan, New Delhi (IN)

(72) Inventors: Deepti Kumari, New Delhi (IN); Fani Bhushan, New Delhi (IN)

( * ) Notice: Subject to any disclaimer, the term of this patent is extended or adjusted under 35 U.S.C. 154(b) by 913 days.

(21) Appl. No.: 17/763,106

(22) PCT Filed: Sep. 23, 2020

(86) PCT No.: PCT/IB2020/058874
§ 371 (c)(1),
(2) Date: Mar. 23, 2022

(87) PCT Pub. No.: WO2021/059150
PCT Pub. Date: Apr. 1, 2021

(65) Prior Publication Data

US 2022/0341099 A1 Oct. 27, 2022

(30) Foreign Application Priority Data

Sep. 23, 2019 (IN) ..... 201911038285

(51) Int. Cl.
*E01C 1/04* (2006.01)

(52) U.S. Cl.
CPC ..... *E01C 1/04* (2013.01)

(58) Field of Classification Search
CPC ..... E01C 1/04
(Continued)

(56) References Cited

U.S. PATENT DOCUMENTS 1,543,080 A * 6/1925 Graves ..... E01C 1/04 404/1
4,592,673 A * 6/1986 Lee ..... E01C 1/04 404/1

(Continued)

FOREIGN PATENT DOCUMENTS

JP 2004324206 11/2004
WO WO-9926211 A2 * 5/1999 ..... E01C 1/04

OTHER PUBLICATIONS

International Search Report received in PCT/IB2020/058874, mailed Dec. 28, 2020, 2 pages.

(Continued)

*Primary Examiner* — Gary S Hartmann
(74) *Attorney, Agent, or Firm* — Klarquist Sparkman, LLP

(57) ABSTRACT

An interchange system includes a first carriageway, a second carriageway, a first ramp, a second ramp, a third ramp, a fourth ramp, a connecting deck, a first traffic weaving section, and a second traffic weaving section. The first ramp and the second ramp extend from a first portion of the first carriageway. The third ramp and the fourth ramp extend from a first portion of the second carriageway. The first ramp is elevated relative to the second ramp. The fourth ramp is elevated relative to the third ramp. The connecting deck connects the first ramp to the fourth ramp. The first traffic weaving section is defined between the first ramp and the connecting deck. The second traffic weaving section is defined between the fourth ramp and the connecting deck. A primary ramp extends from the first traffic weaving section; a secondary ramp extends from the second traffic weaving section.

16 Claims, 7 Drawing Sheets

(58) Field of Classification Search
USPC ..... 404/1
See application file for complete search history.

(56) References Cited

U.S. PATENT DOCUMENTS

| | | | | | |
|---|---|---|---|---|---|
| 4,790,684 | A * | 12/1988 | Adams | E01F 9/529 | 404/1 |
| 5,807,020 | A * | 9/1998 | Chen | E01C 1/04 | 404/1 |
| 10,465,343 | B2 * | 11/2019 | Cheng | B61B 1/00 | |
| 10,597,829 | B2 * | 3/2020 | Sninchak | E01C 1/04 | |
| 2007/0237576 | A1 * | 10/2007 | Peng | E01C 1/04 | 404/1 |
| 2014/0377000 | A1 * | 12/2014 | Chen | E04H 6/08 | 404/1 |
| 2015/0284913 | A1 * | 10/2015 | Fok | E01C 1/04 | 404/1 |

OTHER PUBLICATIONS

Written Opinion received in PCT/IB2020/058874, mailed Dec. 28, 2020, 4 pages.

* cited by examiner

INTERCHANGE SYSTEM FOR A ROADWAY

CROSS REFERENCE TO RELATED APPLICATIONS

This is the U.S. National Stage of International Application No. PCT/IB2020/058874, filed Sep. 23, 2020, which was published in English under PCT Article 21(2), which in turn claims the benefit of India application No. 201911038285, filed Sep. 23, 2019. Both applications are incorporated herein in their entirety by reference.

TECHNICAL FIELD

The present disclosure relates to an interchange system for a roadway.

BACKGROUND

Interchanges, such as flyovers, grade separators, etc., may be required at most intersections to regulate and ease traffic pressure. A minimum height clearance for interchanges, for example, is generally 5.5 meters (or above) for a smooth passage of all types of vehicle. For example, such minimum height clearance may be required so that heavy or larger vehicles, e.g., trucks, may also utilize the interchange for their movement, along with smaller vehicles. Minimum height clearance in interchange structures requires that the interchange structures meet several design related requirements, e.g., a minimum height requirement. However, such meeting such requirements may not be possible at all intersections because of factors, such as land availability, geological conditions, etc., thus making a full-fledged interchange development at many intersections difficult and challenging. Moreover, designing and developing a full-fledged interchange structures consumes lot of labor, time, and money, apart from needing increased land or real estate.

SUMMARY OF THE INVENTION

In one aspect, the disclosure is directed to an interchange system for a roadway including a first carriageway and a second carriageway. The interchange system includes a first ramp, a second ramp, a third ramp, and a fourth ramp. Further, the interchange system includes a connecting deck, a first traffic weaving section, a second traffic weaving section, a primary ramp, and a secondary ramp. The first ramp and the second ramp extends from a first portion of the first carriageway. The first ramp is elevated with respect to the second ramp. The second ramp extends towards and merges with a second portion of the first carriageway to facilitate traffic movement in a first direction over the first carriageway. The third ramp and the fourth ramp extends from a first portion of the second carriageway. The fourth ramp is elevated with respect to the third ramp. The third ramp extends towards and merges with a second portion of the second carriageway to facilitate traffic movement in a second direction over the second carriageway. The connecting deck extends from the first ramp to the fourth ramp over and across the second ramp and the third ramp to connect the first ramp with the fourth ramp. The first traffic weaving section is defined at an interface between the first ramp and the connecting deck and the second traffic weaving section is defined at an interface between the fourth ramp and the connecting deck. The primary ramp extends from the first traffic weaving section up to the second portion of the first carriageway or up to a first portion of an alternate carriageway, and the secondary ramp extends from the second traffic weaving section up to the second portion of the second carriageway or up to a second portion of the alternate carriageway.

DETAILED DESCRIPTION

Reference will now be made in detail to specific embodiments or features, examples of which are illustrated in the accompanying drawings. Generally, corresponding reference numbers will be used throughout the drawings to refer to the same or corresponding parts.

Figure 1:
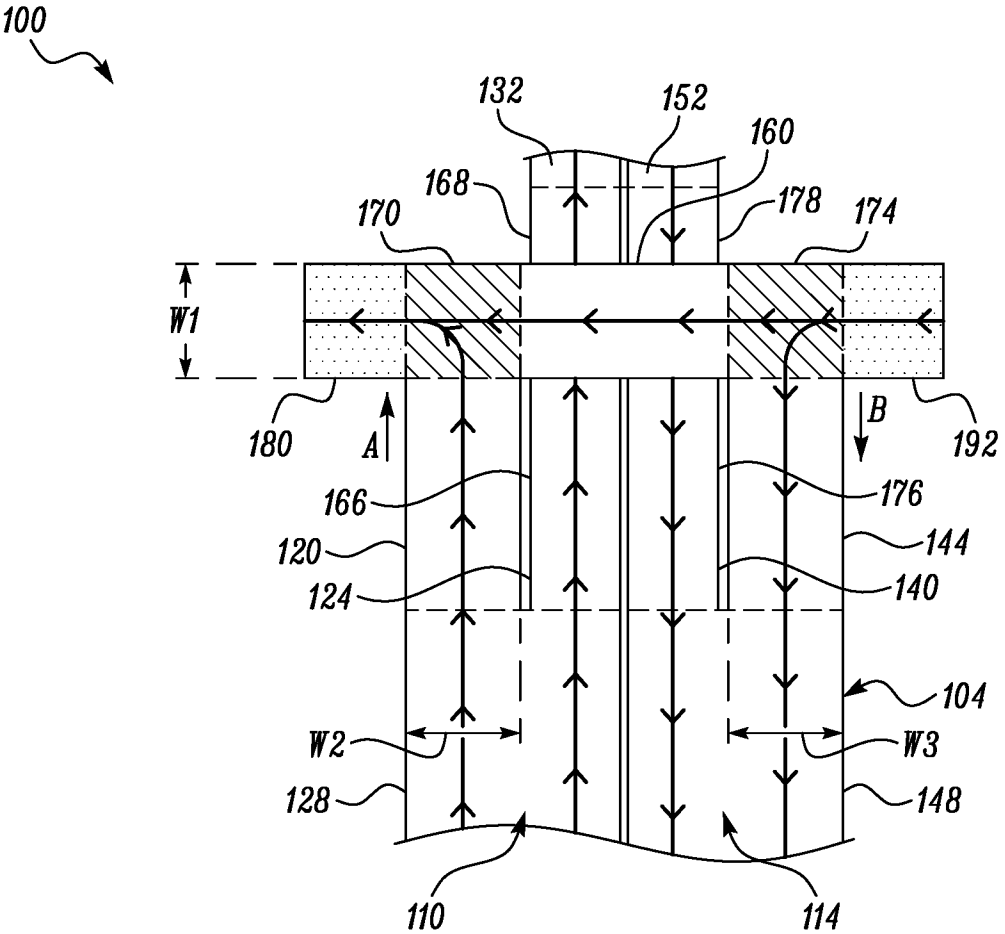
FIG. 1, FIG. 6, and FIG. 7 are illustrations of an exemplary interchange system for a roadway, in accordance with one or more as aspects of the present disclosure.

Referring to FIG. 1, an interchange system 100 for a roadway 104 is shown. The roadway 104 includes a first carriageway 110 and a second carriageway 114. The first carriageway 110 may be configured to facilitate traffic movement in a first direction (e.g., direction, A), while the second carriageway 114 may facilitate traffic movement in a second direction (e.g., direction, B). As an example, the first direction may be opposite to the second direction. As shown, both the first carriageway 110 and the second carriageway 114 may be generally linearly extending carriageways, although profiles of the carriageways may differ in actual practice and application from what has been illustrated and/or disclosed in the present disclosure.

Both the first carriageway 110 and the second carriageway 114 includes corresponding first portions and second portions. For example, the first carriageway 110 includes a first portion 128 and a second portion 132 and the second carriageway 114 includes a first portion 148 and a second portion 152. The first portion 128 of the first carriageway 110 and the first portion 148 of the second carriageway 114 may be defined on one side of the interchange system 100, while the second portion 132 of the first carriageway 110 and the second portion 152 of the second carriageway 114 may be defined on another side of the interchange system 100. In some embodiments, the first portion 128 of the first carriageway 110 and the first portion 148 of the second carriageway 114 are at an existing ground level (EGL) or finished road level (FRL).

According to an embodiment, the second portion 132 of the first carriageway 110 and the second portion 152 of the second carriageway 114 may both extend towards an intersection (not shown). While the second portion 132 of the first carriageway 110 may allow traffic to move away from the interchange system 100 towards the intersection, the second portion 152 of the second carriageway 114 may allow traffic to move towards the interchange system 100 from the intersection.

With continued reference to FIG. 1, the interchange system 100 includes a first ramp 120, a second ramp 124, a third ramp 140, and a fourth ramp 144. Further, the interchange system 100 includes a connecting deck 160, a first traffic weaving section 170, a second traffic weaving section 174, a primary ramp 180, and a secondary ramp 192.

The first ramp 120 and the second ramp 124 extends from the first portion 128 of the first carriageway 110. The first ramp 120 is elevated with respect to the second ramp 124. The second ramp 124 extends towards and merges with the second portion 132 of the first carriageway 110 to facilitate traffic movement in the first direction (direction, A) over the first carriageway 110. The third ramp 140 and the fourth ramp 144 extends from the first portion 148 of the second carriageway 114. The fourth ramp 144 is elevated with respect to the third ramp 140. The third ramp 140 extends towards and merges with the second portion 152 of the second carriageway 114 to facilitate traffic movement in the second direction (direction, B) over the second carriageway 114.

The connecting deck 160 extends from the first ramp 120 to the fourth ramp 144, thereby connecting the first ramp 120 to the fourth ramp 144. The extension is such that the connecting deck 160 spans (e.g., in a transverse manner) over and across the second ramp 124 and the third ramp 140 to connect the first ramp 120 with the fourth ramp 144. In this regard, the second ramp 124 and the third ramp 140 are disposed adjacent to each other, and may lie in between the first ramp 120 and the fourth ramp 144.

In some embodiments, the second ramp 124 and the third ramp 140 are respectively depressed with respect to a level defined by the first portion 128 of the first carriageway 110 and the first portion 148 of the second carriageway 114. In this regard, the second ramp 124 may be formed by a first slope portion 166 that extends (e.g., descends or slopes downwards) from the first portion 128 of the first carriageway 110 and a second slope portion 168 that extends (e.g., ascends or slopes upwards) up to the second portion 132 of the first carriageway 110. On similar lines, the third ramp 140 may be formed by a third slope portion 176 that extends (e.g., descends or slope downwards) from the first portion 148 of the second carriageway 114 and a fourth slope portion 178 that extends (e.g., ascends or slope upwards) up to the second portion 152 of the second carriageway 114.

In some embodiments, a first deck 150 is defined between the first slope portion 166 and the second slope portion 168 of the second ramp 124. Similarly, in some embodiments, a second deck 154 is defined between the third slope portion 176 and the fourth slope portion 178 of the third ramp 140. For clarity, the first deck 150 and the second deck 154 have been illustrated in FIG. 6 alone. Although not limited, the first deck 150 and the second deck 154 may be disposed (e.g., directly) under or beneath the connecting deck 160, and, therefore, the first deck 150 and the second deck 154 may combinedly define a lower deck while the connecting deck 160 may define an upper deck. In some embodiments, the first deck 150 and the second deck 154 may be disposed at the same level with each other. In some embodiments, a distance or a clearance between the upper deck (i.e., connecting deck 160) and the lower deck (i.e., first deck 150 and the second deck 154) may be not lesser than 3.5 meters. Further, although not limited, a depression defined by the second ramp 124 and the third ramp 140 may be maximum at the first deck 150 and the second deck 154. Furthermore, a width, W1, of the connecting deck 160 may be up to 2.5 times a width, W2, of the first ramp 120 and/or a width, W3, of the fourth ramp 144.

Figure 6:
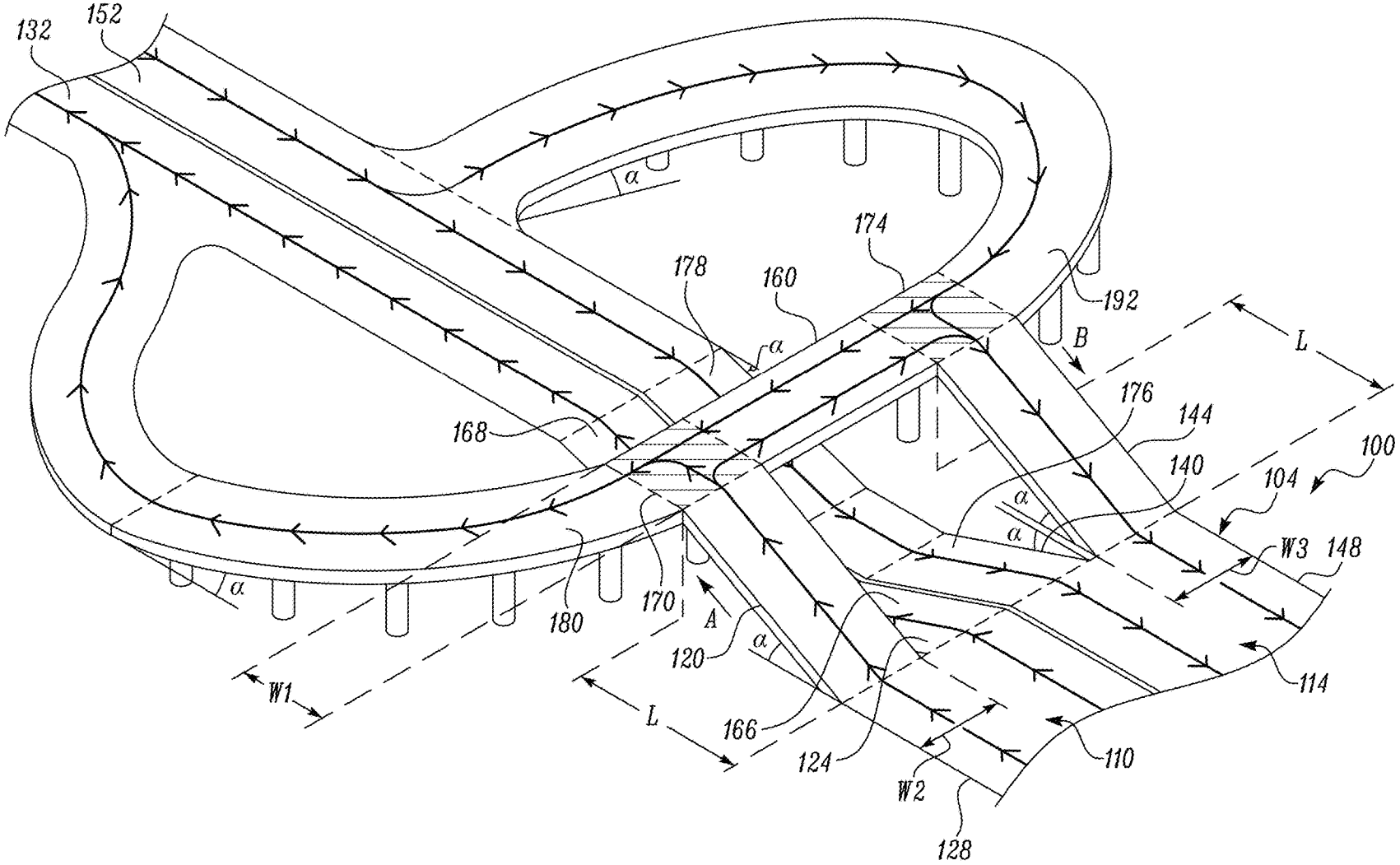

In some embodiments, each of the first ramp 120, second ramp 124, third ramp 140, and the fourth ramp 144 may define a length (see example length, L, FIG. 6). It may be noted that length, L, is commonly demarcated for each of the first ramp 120, second ramp 124, third ramp 140, and the fourth ramp 144. In actual practice or application, however, a length of one ramp may differ from a length of another ramp. Therefore, the lengths of the ramps may be understood as extensions of the ramps between the corresponding first portions of the corresponding carriageways to the corresponding decks and/or the corresponding weaving portions.

While commonly a ramp may be built at 1%-6% gradient or slope, said lengths of one or more of the first ramp 120, second ramp 124, third ramp 140, and the fourth ramp 144, may be not more than one of: 50 meter in length at 4% gradient or slope; 60 meter in length at 3% gradient or slope; 90 meter in length at 2% gradient or slope; or 165 meter in length at 1% gradient or slope, according to certain scenarios. Such ramp lengths at their corresponding gradients or slopes may enable other structures (e.g., another intersection) be built relatively close or in adequate proximity to the interchange system 100, may not obstruct an entry/exit of societies disposed adjacent to the interchange system 100, may ease moving of slow moving traffic on the ramps, may be less costly and cumbersome to build, etc. Certain example scenarios are provided further below in which such ramp lengths at their corresponding gradients or slopes may be applicable. Each of these scenarios may be independently applicable or may be applicable in concert with each other.

In this regard, the connecting deck 160 may define a height with respect to a level of the first portion 128 of the first carriageway 110 and the first deck 150 may define a depth with respect to a level of the first portion 128 of the first carriageway 110. With regard to a first scenario, if a magnitude of the height is larger than a magnitude of the depth, a length of the first ramp 120 may be not more than one of: 50 meter in length at 4% gradient or slope; 60 meter in length at 3% gradient or slope; 90 meter in length at 2% gradient or slope; or 165 meter in length at 1% gradient or slope. With regard to a second scenario, if a magnitude of the depth is larger than a magnitude of the height, a length of the second ramp 124 may be not more than one of: 50 meter in length at 4% gradient or slope; 60 meter in length at 3% gradient or slope; 90 meter in length at 2% gradient or slope; or 165 meter in length at 1% gradient or slope.

Similarly, the connecting deck 160 may define a height with respect to a level of the first portion 148 of the second carriageway 114 and the second deck 154 defines a depth with respect to a level of the first portion 148 of the second carriageway 114. With regard to a third scenario, if a magnitude of said height is larger than a magnitude of said depth, a length of the fourth ramp 144 may be not more than one of: 50 meter in length at 4% gradient or slope; 60 meter in length at 3% gradient or slope; 90 meter in length at 2% gradient or slope; or 165 meter in length at 1% gradient or slope. With regard to a fourth scenario, if a magnitude of said depth is larger than a magnitude of said height, a length of the third ramp 140 may be not more than one of: 50 meter in length at 4% gradient or slope; 60 meter in length at 3% gradient or slope; 90 meter in length at 2% gradient or slope; or 165 meter in length at 1% gradient or slope.

The first traffic weaving section 170 is defined at an interface between the first ramp 120 and the connecting deck 160 and the second traffic weaving section 174 is defined at an interface between the fourth ramp 144 and the connecting deck 160. The purpose of the first traffic weaving section 170 and the second traffic weaving section 174 is to either facilitate a merging of traffic flow or facilitate a splitting of the traffic flow, depending on the direction of traffic flow. Such aspects of weaving traffic shall be discussed further below in the present disclosure.

Further, as shown, the primary ramp 180 extends from the first traffic weaving section 170 up to a first portion 184 of an alternate carriageway 188. Similarly, the secondary ramp 192 extends from the second traffic weaving section 174 up to a second portion 196 of the alternate carriageway 188. According to some embodiments of the present disclosure, the primary ramp 180 may alternatively extend up to the second portion 132 of the first carriageway 110 instead, and, similarly, the secondary ramp 192 may alternatively extend up to the second portion 152 of the second carriageway 114 instead.

Each of the first ramp 120, the second ramp 124, the third ramp 140, the fourth ramp 144, the connecting deck 160, the first traffic weaving section 170, the second traffic weaving section 174, the primary ramp 180, and the secondary ramp 192, may be one or more of linear, curved, bent, and/or may possess a multitude of other profiles, as may be warranted at actual sites based on factors such as land availability, cost, feasibility, geological conditions, etc. Accordingly, the shapes and configurations of each of the first ramp 120, the second ramp 124, the third ramp 140, the fourth ramp 144, the connecting deck 160, the first traffic weaving section 170, the second traffic weaving section 174, the primary ramp 180, and the secondary ramp 192, as illustrated and disclosed in the present disclosure, need to be seen as being purely exemplary.

The alternate carriageway 188 may be part of another roadway similar to the roadway 104 and may be configured to facilitate traffic movement in a one way direction (or in a third direction, e.g., direction, C, as shown). The third direction may be different from the first direction and the second direction, and, in one embodiment, the third direction may be generally transversal to one or more of the first direction and the second direction.

FIGS. 2-5 various shapes and configurations of the alternate carriageway 188 are discussed, and exemplify one or more areas of application of the interchange system 100. For example, in FIG. 2, both the first portion 184 and the second portion 196 of the alternate carriageway 188 include an L-shaped configuration; in FIG. 3, both the first portion 184 and the second portion 196 of the alternate carriageway 188 include a linear configuration; in FIG. 4, one of the first portion 184 or the second portion 196 of the alternate carriageway 188 includes an L-shaped configuration and the other of the first portion 184 and the second portion 196 of the alternate carriageway 188 includes a linear configuration; in FIG. 5, both the first portion 184 and the second portion 196 of the alternate carriageway 188 include an angular configuration, or are disposed at an angular offset with respect to direction, C, or with respect to one or more of the first carriageway 110 and the second carriageway 114.

In actual practice and application, said shapes and configurations of the alternate carriageway 188 may be applied in any combination with each other. Further, the first portion 184 and the second portion 196 of the alternate carriageway 188 may also include curves, bends, and a multitude of other profiles, as may be warranted at actual sites and/or locations based on factors such as land availability, cost, feasibility, geological conditions, etc. Accordingly, the shapes and configurations of the alternate carriageway 188, as discussed and illustrated herein in conjunction with the interchange system 100, need to be seen as being purely exemplary.

Figure 7:
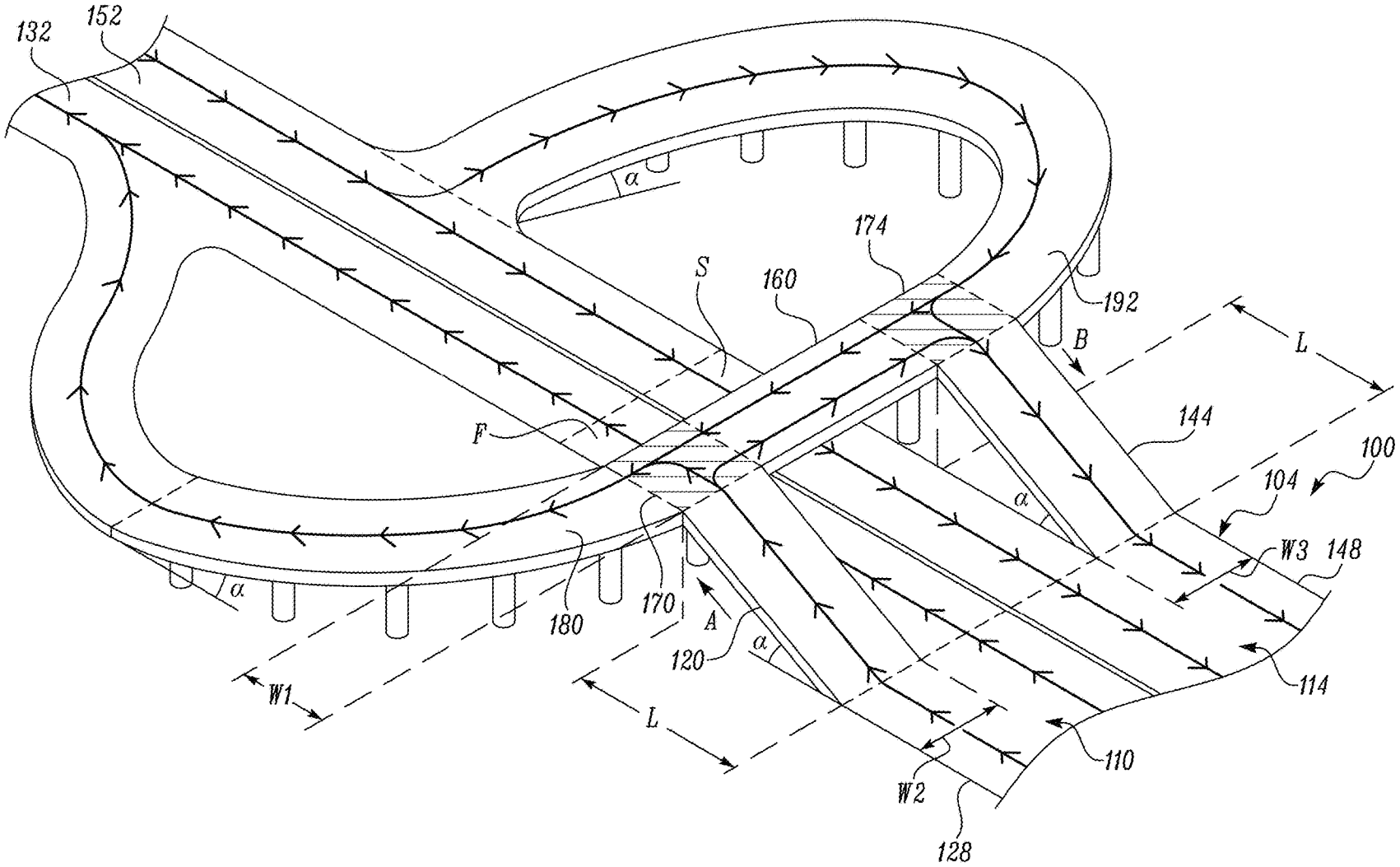

Referring to FIGS. 6 and 7, exemplary illustrations of a perspective view of the exemplary interchange system 100 are disclosed. As shown, the primary ramp 180 extends from the first traffic weaving section 170 up to the second portion 132 of the first carriageway 110. Further, the secondary ramp 192 extends from the second traffic weaving section 174 up to the second portion 152 of the second carriageway 114. The first carriageway 110 includes the second ramp 124 or a first intermediate portion 'F' between the first portion 128 and the second portion 132 of the first carriageway 110, and the second carriageway 114 includes the third ramp 140 or a second intermedial portion 'S' between the first portion 148 and the second portion 152 of the second carriageway 114.

INDUSTRIAL APPLICABILITY

Referring to FIGS. 2-6, traffic flowing along direction, A, on the first portion 128 of the first carriageway 110 may be split such that the heavier traffic (e.g., buses and trucks) may divert and move on to the first ramp 120, while the lighter traffic (passenger cars, etc.) may divert and move onto the second ramp 124. Once the heavier traffic may be split from the lighter traffic, said heavier traffic may reach up to the first traffic weaving section 170 and may weave (e.g., merge) with the traffic travelling on the connecting deck 160 along direction, C.

Figure 2:
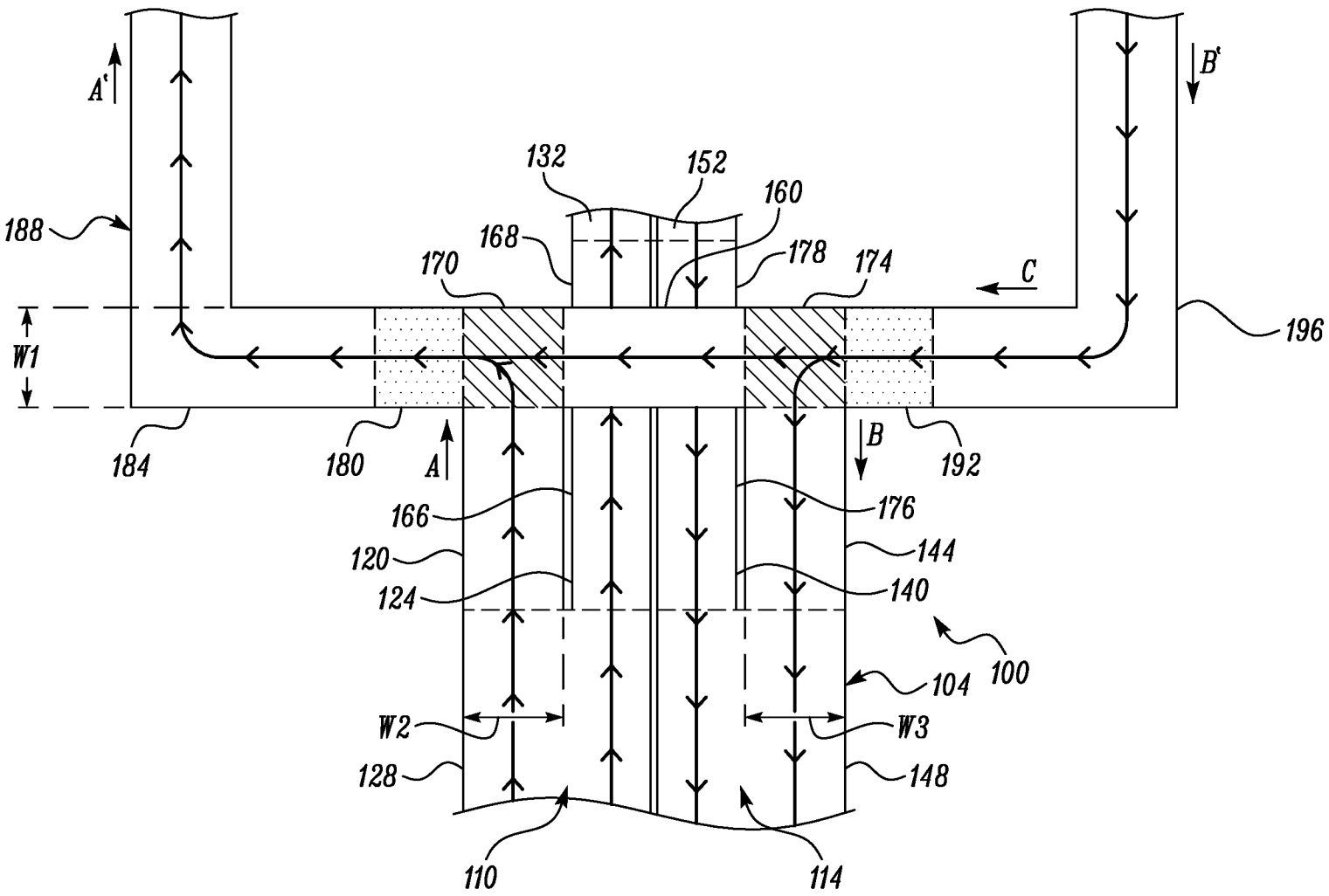
FIGS. 2-5 are various exemplary junctions at which the interchange system is applied in which the interchange system facilitates a movement of traffic between the roadway and an alternate carriageway, in accordance with one or more aspects of the present disclosure.
Figure 3:
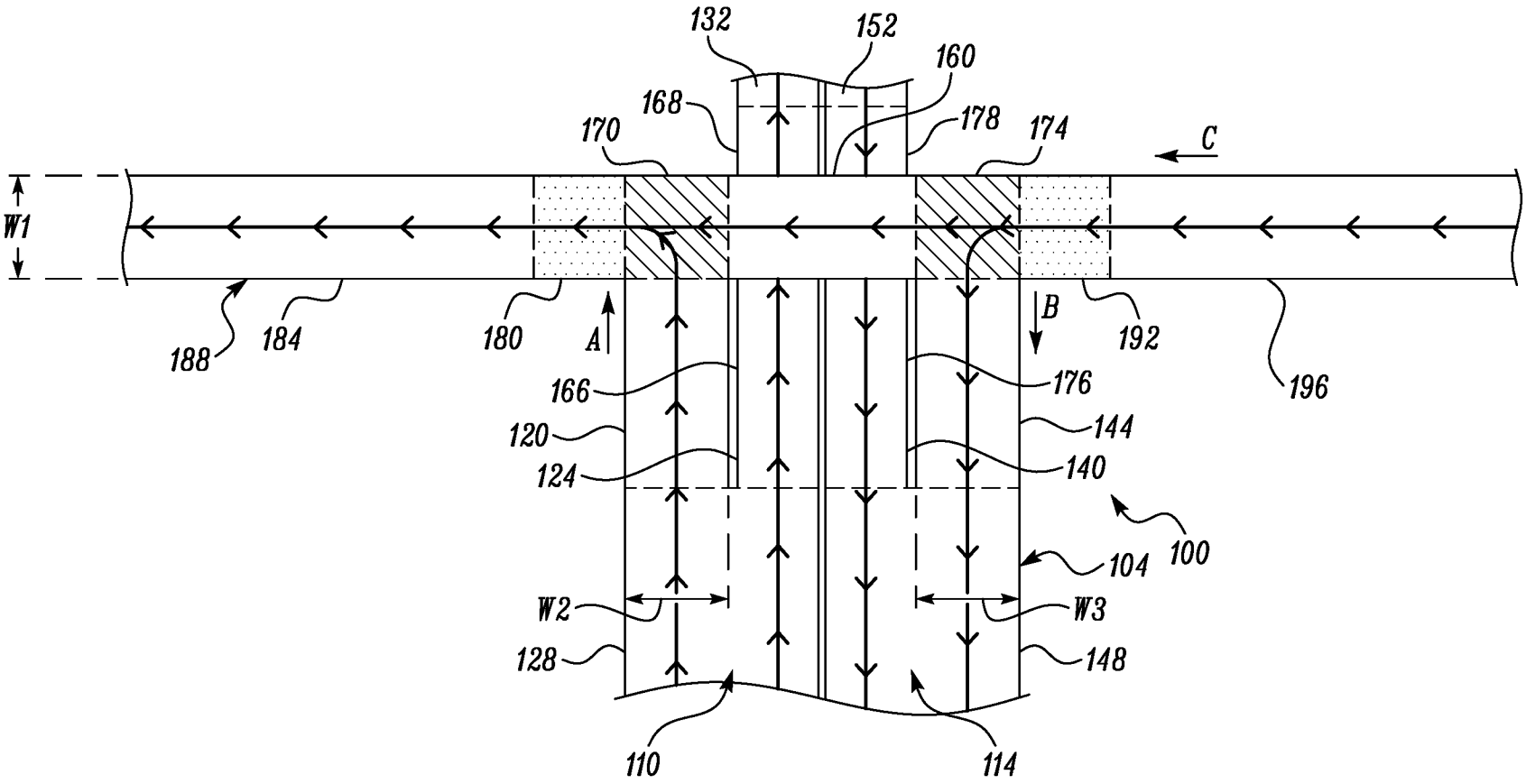
Figure 4:
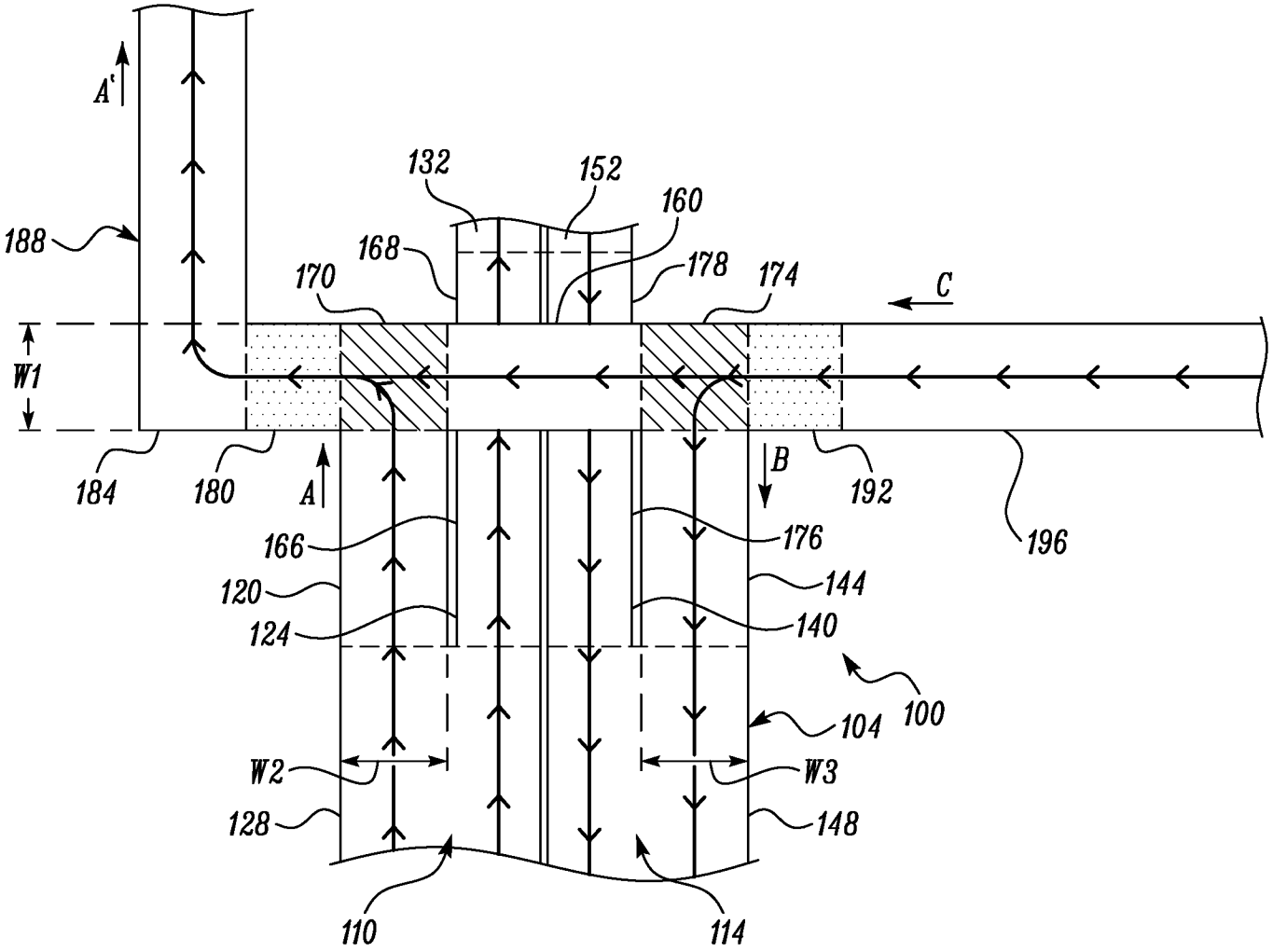
Figure 5:
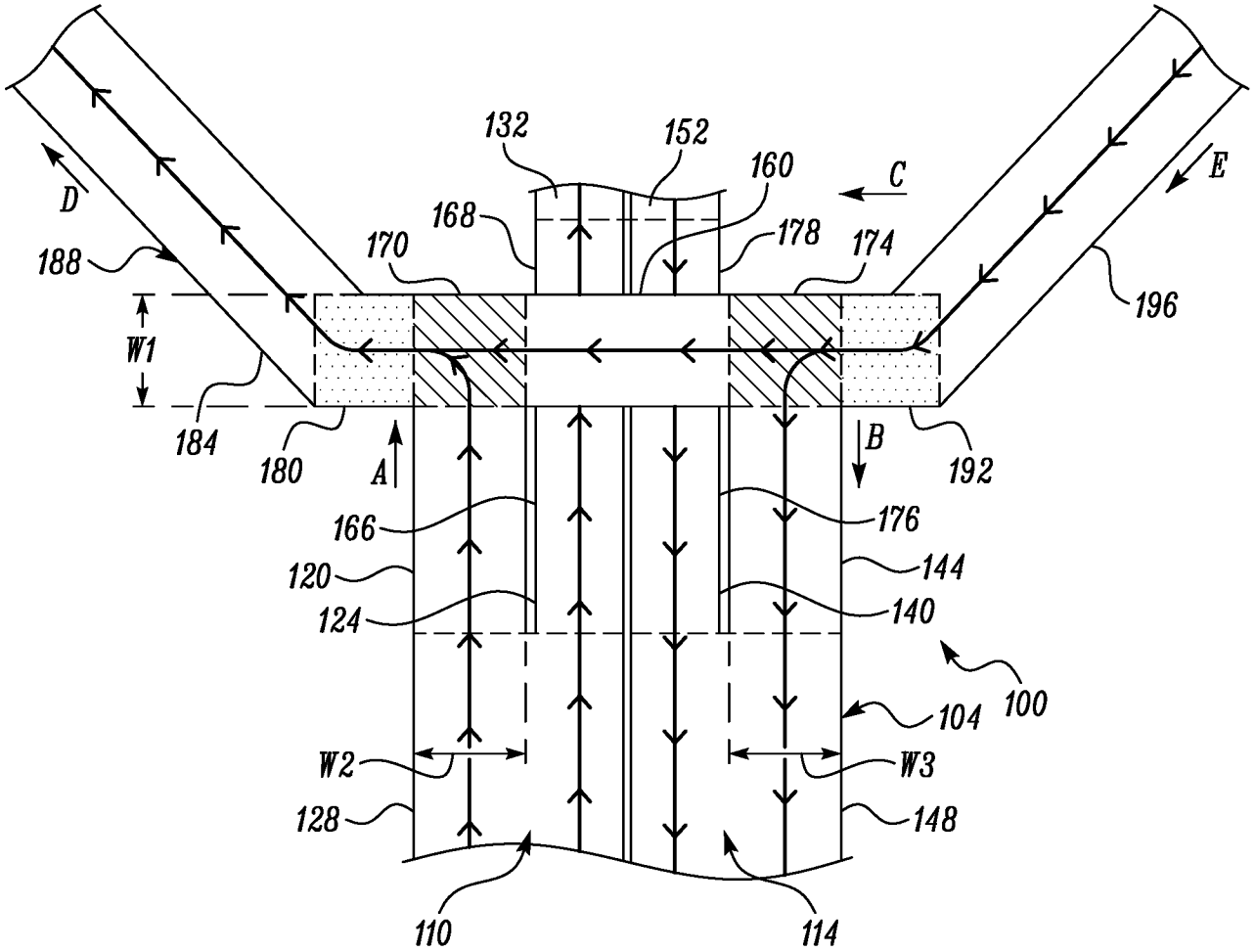

Next, said heavier traffic may move onto the primary ramp 180 to continue its movement along direction, C, and may advance onto the first portion 184 of the alternate carriageway 188. Once on the first portion 184, the heavier traffic may change course to direction, A', as shown in FIG. 2 or 4; or continue along direction, C, as shown in FIG. 3; or change course to direction, D, as shown in FIG. 5. In some cases, said heavier traffic is lead at least 20 meters away from the first ramp 120 over the primary ramp 180. If required, the first ramp 120 may be used by the lighter traffic as well.

With regard to the incoming traffic onto the second carriageway 114 from the alternate carriageway 188, as said incoming traffic (may include one or more of heavy traffic and light traffic) may move on the second portion 196 of the alternate carriageway 188 along direction, B', as shown in FIG. 2; or along direction, C, as shown in FIGS. 3 and 4; or along direction, E, as shown in FIGS. 5 and 6, said incoming traffic may advance onto the secondary ramp 192 and change or continue course to direction, C, and further move onto the second traffic weaving section 174. At this point, said incoming traffic flowing along direction, C, may weave (e.g., split), and part of the incoming traffic may continue movement along the direction, C, while the other part may advance onto the fourth ramp 144 and change course to direction, B. Further, this part or portion of the incoming traffic may enter onto the first portion 148 of the second carriageway 114, merge with the traffic moving on the second carriageway 114 and continue movement along direction, B. In some cases, said part or portion of the incoming traffic is lead at least 20 meters away from the fourth ramp 144 over the first portion 148 of the second carriageway 114.

By way of the interchange system 100, heavier traffic may be split at the exit of the first portion 128 and the entry onto the first ramp 120 and second ramp 124. In particular, with the heavier traffic splitting and moving over onto the first ramp 120, the interchange system 100 takes away substantial traffic burden from along a further expanse of the roadway 104 along direction, A, thereby regulating movement of overall traffic. Such splitting also helps in maintaining an overall height (i.e., depth or depression) between the connecting deck 160 and the first deck 150 and/or the second deck 154 relatively low (e.g., lesser than 5.5 meters or 3.5 meters) at its maximum depth or at its maximum depression relative to the connecting deck 160 since only lighter traffic may pass through the second ramp 124 and third ramp 140.

Further, when, for example, the interchange system 100 is applied in an area where an intersection (not shown) lies ahead along direction, A, a substantial reduction in traffic burden at the interchange system 100 also eases traffic burden at the intersection. If, at any point, the heavier traffic required to return to the second portion 132 of the first carriageway 110, the heavier traffic may chart another (available) course to do so, so as to return to travel along the first direction (i.e., direction, A) on the first carriageway 110. It may be noted that the interchange system 100, as discussed above, resolves and/or removes one or more traffic conflict points that may exist at the intersection, and creates a partial interchange for the said intersection, thereby easing the traffic burden at the intersection.

It will be apparent to those skilled in the art that various modifications and variations can be made to the method and/or system of the present disclosure without departing from the scope of the disclosure. Other embodiments will be apparent to those skilled in the art from consideration of the specification and practice of the method and/or system disclosed herein. It is intended that the specification and examples be considered as exemplary only, with a true scope of the disclosure being indicated by the following claims and their equivalent.

We claim:

1. An interchange system for a roadway including a first carriageway and a second carriageway, the interchange system comprising:

a first ramp and a second ramp extending from a first portion of the first carriageway, wherein the first ramp is elevated with respect to the second ramp, the second ramp or a first intermediate portion 'F' of the first carriageway, and wherein the second ramp or the first intermediate portion 'F' extends towards and merges with a second portion of the first carriageway to facilitate traffic movement in a first direction over the first carriageway;

a third ramp or a second intermediate portion 'S' of the second carriageway and a fourth ramp extending from a first portion of the second carriageway, wherein the fourth ramp is elevated with respect to the third ramp, or the second intermediate portion 'S', and wherein the third ramp or the second intermediate portion 'S' extends towards and merges with a second portion of the second carriageway to facilitate traffic movement in a second direction over the second carriageway;

a connecting deck extending from the first ramp to the fourth ramp over and across the second ramp or the first intermediate portion 'F' and the third ramp or the second intermediate portion 'S' to connect the first ramp with the fourth ramp;

a first traffic weaving section being defined at an interface between the first ramp and the connecting deck and a second traffic weaving section being defined at an interface between the fourth ramp and the connecting deck; and a primary ramp extending from the first traffic weaving section up to the second portion of the first carriageway, and a secondary ramp extending from the second traffic weaving section up to the second portion of the second carriageway, wherein the connecting deck interconnects the first ramp, the fourth ramp, the primary ramp, and the secondary ramp to facilitate the traffic movement in the first direction and the second direction.

2. The interchange system as claimed in claim 1, wherein the primary ramp extends from the first traffic weaving section up to a first portion of an alternate carriageway, and the secondary ramp extending from the second traffic weaving section up to a second portion of the alternate carriageway, and wherein the first portion of the alternate carriageway, the primary ramp, the first traffic weaving section, the connecting deck, the second traffic weaving section, the secondary ramp, and the second portion of the alternate carriageway, facilitate traffic movement in a third direction over the alternate carriageway.

3. The interchange system as claimed in claim 2, wherein the second portion of the first carriageway and the second portion of the second carriageway extends towards an intersection where the roadway extends across another roadway having at least one another carriageway, wherein the first portion of the alternate carriageway, the primary ramp, the first traffic weaving section facilitates traffic movement from the first carriageway to the at least one another carriageway, and the second traffic weaving section, the secondary ramp, and the second portion of the alternate carriageway facilitates traffic movement from the at least one another carriageway to the second carriageway.

4. The interchange system as claimed in claim 1, wherein the first portion of the first carriageway and the first portion of the second carriageway are at an existing ground level (EGL) or finished road level (FRL).

5. The interchange system as claimed in claim 1, wherein the second ramp and the third ramp are depressed with respect to a level defined by the first portion of the first carriageway and the first portion of the second carriageway.

6. The interchange system as claimed in claim 1, wherein the first direction and the second direction are opposite to each other.

7. The interchange system as claimed in claim 1, wherein the second ramp defines a first slope portion extending from the first portion of the first carriageway and a second slope portion extending up to the second portion of the first carriageway, a first deck being defined between the first slope portion and the second slope portion of the second ramp.

8. The interchange system as claimed in claim 7, wherein the connecting deck defines a height with respect to a level of the first portion of the first carriageway and the first deck defines a depth with respect to a level of the first portion of the first carriageway, wherein if a magnitude of the height is larger than a magnitude of the depth, a length of the first ramp is not more than one of:

50 meter in length at 4% gradient or slope;
60 meter in length at 3% gradient or slope;
90 meter in length at 2% gradient or slope; or
165 meter in length at 1% gradient or slope; and if a magnitude of the depth is larger than a magnitude of the height, a length of the second ramp is not more than one of:

50 meter in length at 4% gradient or slope;
60 meter in length at 3% gradient or slope;
90 meter in length at 2% gradient or slope; or
165 meter in length at 1% gradient or slope.

9. The interchange system as claimed in claim 1, wherein the third ramp defines a third slope portion extending from the first portion of the second carriageway and a fourth slope portion extending up to the second portion of the second carriageway, a second deck being defined between the third slope portion and the fourth slope portion of the third ramp.

10. The interchange system as claimed in claim 9, wherein the connecting deck defines a height with respect to a level of the first portion of the second carriageway and the second deck defines a depth with respect to a level of the first portion of the second carriageway, wherein if a magnitude of the height is larger than a magnitude of the depth, a length of the fourth ramp is not more than one of:

50 meter in length at 4% gradient or slope;

60 meter in length at 3% gradient or slope;

90 meter in length at 2% gradient or slope; or 165 meter in length at 1% gradient or slope; and if a magnitude of the depth is larger than a magnitude of the height, a length of the third ramp is not more than one of:

50 meter in length at 4% gradient or slope;

60 meter in length at 3% gradient or slope;

90 meter in length at 2% gradient or slope; or 165 meter in length at 1% gradient or slope.

11. The interchange system as claimed in claim 1, wherein the connecting deck facilitates the traffic movement between the first carriageway and the second carriageway without stoppage of the traffic movement along the connecting deck.

12. The interchange system as claimed in claim 1, wherein the connecting deck facilitates a transfer of traffic from the first carriageway in the first direction to the second carriageway in the second direction, or from the second carriageway in the second direction to the first carriageway in the first direction without stoppage of the traffic movement along the connecting deck.

13. The interchange system as claimed in claim 1, wherein the connecting deck is devoid of one or more crossovers or one or more intersections.

14. The interchange system as claimed in claim 1, wherein the second portion of the first carriageway and second portion of the second carriageway extend towards an intersection and the interchange system is provided away from the intersection to ease traffic burden from the intersection.

15. The interchange system as claimed in claim 1, wherein the first traffic weaving section and the second traffic weaving section facilitate a merging or a splitting of an incoming traffic flow at the first traffic weaving section and the second traffic weaving section respectively, and a redirection of the traffic flow onto first ramp, the fourth ramp, the primary ramp, the secondary ramp, or any combination thereof after the merging or the splitting.

16. The interchange system as claimed in claim 1, wherein the first ramp, the fourth ramp, the primary ramp, and the secondary ramp facilitate deviation of traffic away from the second ramp or the first intermediate portion 'F' and the third ramp or the second intermediate portion 'S'.

* * * * *